United States Patent [19]

Staker et al.

[11] Patent Number: 4,715,866

[45] Date of Patent: Dec. 29, 1987

[54] DERIVATIVES OF POLYETHER GLYCOL ESTERS OF POLYCARBOXYLIC ACIDS AS RHEOLOGICAL ADDITIVES FOR COAL-WATER SLURRIES

[75] Inventors: Donald D. Staker; William S. Kain, both of Cincinnati, Ohio

[73] Assignee: National Distillers and Chemical Corporation, New York, N.Y.

[21] Appl. No.: 45,728

[22] Filed: Apr. 30, 1987

Related U.S. Application Data

[63] Continuation of Ser. No. 819,088, Jan. 15, 1986, abandoned.

[51] Int. Cl.[4] ..... C10L 1/32

[52] U.S. Cl. ..... 44/51; 44/66; 44/70; 44/77; 252/311; 252/356

[58] Field of Search ..... 44/51, 70, 77; 252/66, 252/311, 356

[56] References Cited

U.S. PATENT DOCUMENTS

| | | | |
|---|---|---|---|
| 4,129,508 | 12/1978 | Friihauf | 44/51 |
| 4,534,450 | 6/1987 | Ljusberg-Wahren | 44/51 |

FOREIGN PATENT DOCUMENTS

| | | | |
|---|---|---|---|
| 0131558 | 1/1985 | European Pat. Off. | 44/51 |
| 58-0215489 | 12/1983 | Japan | 44/51 |
| 59-0145292 | 8/1984 | Japan | 44/51 |
| 0842036 | 4/1984 | Rep. of Korea | 44/51 |
| 8303863 | 7/1983 | Sweden | 44/51 |

*Primary Examiner*—William R. Dixon, Jr.
*Assistant Examiner*—Margaret B. Medley
*Attorney, Agent, or Firm*—Kenneth D. Tremain; Gerald A. Baracka

[57] ABSTRACT

Coal-water slurries containing a rheological additive are disclosed. The rheological additives employed for the preparation of the present coal-water slurries are ester products obtained from the reaction of a polycarboxylic organic acid with two or more hydroxylic compounds. Salts of these reaction products may also be employed. The rheological additive is employed in an amount from about 0.1 to about 4 percent by weight of the slurry, the slurry having from about 60 to about 80 percent by weight solids, the balance being water.

32 Claims, No Drawings

DERIVATIVES OF POLYETHER GLYCOL ESTERS OF POLYCARBOXYLIC ACIDS AS RHEOLOGICAL ADDITIVES FOR COAL-WATER SLURRIES

This application is a continuation of application Ser. No. 819,088, filed Jan. 15, 1986, now abaonded.

BACKGROUND OF THE INVENTION

1. Field of the Invention

This invention relates to a coal-water slurry having a rheological additive which is the reaction product of a polycarboxylic organic acid and two or more hydroxylic compounds, one of which is necessarily a polyether glycol. The ester reaction product is employed in an amount from about 0.1 to about 4% by weight of the coal-water slurry, the slurry having from about 60 to about 80% by weight of solids, the balance being water.

2. Description of the Prior Art

In recent years a great deal of interest has developed in utilizing coal-water slurries in lieu of oil for electric power generation not only because of the lower cost of coal but also because ofits availability.

Coal-water slurries have been produced with solids contents of about 60 to about 75% which are fluid and handle in about the same way as petroleum fuels. These coal-water slurries may be burned directly wittout need of dewatering the mixture. The heat generated during combustion is sufficiency high so that the water in the slurry does not prevent it from being used to generate power. Naturally, as the solids of the coal-water slurry increase, the fuel value of the slurry also increases. For this reason, slurries having less than about 50 to 55% solids are unsuitable primarily for economic reasons.

One of the difficulties encountered with coal-water slurries at a solids content of about 60% and higher is that the dispersion of coal in water becomes an immobile mass and when burned it has to be handled in the same manner as lump coal. Handling in this respect includes not only transportation of the coal from the mine source but also the delivery of the coal to a combustion chamber such as the firebox of a steam boiler. Unless coal-water slurries have the same liquidity as oil at these higher solids content so that they may be transported by pipeline and injected into a firebox by spraying, the advantage of using a liquid carrier (i.e., water) for the coal is lost. Stated otherwise, the particles of coal in the slurry at these higher solids levels tend to convert the liquid carrier (water) into a plastic mass whereby the advantage of employing a liquid carrier is lost.

The prior art has overcome some of these difficulties by providing additives which may be used in relatively small amounts to assure that the coal-water slurry at high solids content is fluid. Examples of these additives are given by Kovacs in U.S. Pat. No. 4,435,306, Sakaria U.S. Pat. No. 4,398,919 and in European patent application Ser. No. 0131558. Coal-fuel oil slurries containing a dispersing agent are also described by Schmolka et al. in U.S. Pat. No. 4,288,232, Naka et al. U.S. Pat. No. 4,251,229 and Shimizu et al. U.S. Pat. No. 4,187,078.

SUMMARY OF THE INVENTION

The present invention relates to coal-water slurries prepared using novel rheological additives comprising the reaction product of a polycarboxylic organic acid having from about 16 to 60 carbon atoms and from 2 up to 4 carboxyl groups with (a) a polyether glycol having recurring oxyalkylene groups containing up to 4 carbon atoms and a molecular weight from about 1,000 to about 20,000 and (b) an organic aliphatic hydroxylic compound having a molecular weight less than 1,000 and containing 1 or 2 hydroxyl groups. The polycarboxylic acid has at least 55 percent up to essentially 100 percent of the available carboxyl groups reacted and the molar ratio of (a) to (b) ranges from about 4:1 to 1:4 and, more preferably, 2:1 to 1:2. The rheological additive is employed in an amount from about 0.1 percent to about 4 percent and, more preferably, from 0.25 to 1.5 percent in slurries containing from about 60 to about 80 percent by weight solids.

Polycarboxylic acids used for the preparation of the additives of the invention are selected from the group consisting of dimer acids, trimer acids, adducts of unsaturated monocarboxylic acids or dimer acids with maleic anhydride in a molar ratio of about 1:1, adducts of linoleic acid or similar unsaturated monocarboxylic acids with acrylic-type acids in a molar ratio of about 1:1, and adducts of olefins having about 12 to about 40 carbon atoms with maleic acid or maleic anhydride in a molar ratio of about 1:1.

The polyether glycol (a) is selected from the group consisting of polyethylene glycol, polypropylene glycol, and poly(ethylene-propylene) glycol Polyethylene glycol having a molecular weight from about 3,000 to 12,000 is particularly useful for the preparation of the rheological additives of this invention.

Especially useful hydroxylic compounds (b) are selected from the group consisting of n-decyl alcohol, 2-ethyl-1,3-hexanediol, dipropylene glycol, polyethylene glycol having a molecular weight from 200 to 600, polypropylene glycol having a molecular weight from 400 to 450, and N-methyldiethanolamine.

The resulting ester products have more than 55 percent and, more generally, greater than 75 percent of the carboxyl functionality reacted. In one embodiment of the invention, all or a portion of any remaining carboxyl groups are converted to a salt form. Salts of ammonia and the group IA or IIA metals, especially sodium or potassium, are particularly useful for this purpose.

DETAILED DESCRIPTION OF THE INVENTION

The rheological additives of this invention are predominantly ester products obtained by reacting a polycarboxylic acid with a mixture of hydroxylic compounds. One of the hydroxylic compounds is necessarily a polyether glycol of relatively high molecular weight while the second hydroxylic compound may be a lower molecular weight polyether glycol or another type hydroxylic material. The polycarboxylic acid can be fully esterified or a portion of the carboxyl moieties can remain unreacted. In preparing the ester products, the polycarboxylic acid may be reacted with a mixture of the first polyether glycol and second hydroxylic compound or the esterification may be carried out in a sequential, i.e., stepwise, manner. The complete or partial ester products of this invention are useful as rheological additives for coal-water slurries.

Polycarboxylic organic acids employed to obtain the ester products of the invention have from about 16 to about 60 carbon atoms, especially from 21 to about 54 carbon atoms, and from 2 up to about 4 carboxyl groups. The acids may be either dimer acids, trimer acids, adducts of unsaturated monocarboxylic acids or dimer acids with maleic anhydride in a molar ratio of about 1:1, adducts of linoleic acid and similar unsaturated monocarboxylic acids with acrylic-type acids in a molar ratio of about 1:1, or adducts of olefins having about 12 to about 40 carbon atoms with maleic acid or maleic anhydride in a molar ratio of about 1:1.

Dimer acids are known in the art and described by Barrett et al. in U.S. Pat. No. 2,793,220 and Myers et al. U.S. Pat. No. 2,955,121 which are incorporated herein by reference. Trimer acids are also known in the art and are described by Barrett et al. in U.S. Pat. No. 3,097,220 which is incorporated herein by reference. The dimer acid is obtained by oligomerizing an unsaturated 18 carbon atom naturally occurring unsaturated acyclic monocarboxylic fatty acid such as oleic acid, linoleic acid, linolenic acid and the like to obtain a 36 carbon atom dicarboxylic acid whereas the trimer acid is obtained by oligomerizing the foregoing unsaturated monocarboxylic acids to obtain a 54 carbon atom tricarboxylic acid. In both of these reactions, other products are obtained; however, the reaction is conducted in a manner so that the reaction product is principally the dimer acid or the trimer acid. Other unsaturated acyclic monocarboxylic acids having at least one ethylenically unsaturated position and from about 10 to about 22 carbon atoms can also be used to make the polycarboxylic acids of the present invention. These include decenoic, undecenoic, pentadecenoic, hexadecenoic acids and the like. Unsaturated acyclic monocarboxylic acids of the above types may be obtained from natural fats and oils such as tall oil, linseed oil, tung oil, soy oil, rapeseed oil, corn oil, fish oil, beef tallow and mixtures thereof.

Dimer acid prepared as described in the foregoing references containing 75% or more of dimer acid is preferred whereas trimer acid prepared according to the foregoing references having 60% or more of trimer acids is preferred. Mixtures of dimer acid and trimer acid are also useful and advantageously employed.

Adducts of maleic anhydride (or acid) with unsaturated monocarboxylic acids and dimer acids are known in the art and are described in U.S. Pat. Nos. 2,902,499 and 2,975,133 which are incorporated herein by reference. These adducts are prepared by heating maleic anhydride and an unsaturated acid at a temperature from about 100° C. to about 300° C. until the addition reaction is completed. The molar ratio of the maleic anhydride to unsaturated acid is generally about 1:1.

A 21 carbon atom dicarboxylic acid designated Westvaco 1550 (trademark) may be employed as the polycarboxylic acid and comprises the addition product of an 18 carbon atom monocarboxylic unsaturated acid (linoleic acid) and acrylic acid. Equivalent unsaturated monocarboxylic acids having at least two ethylenically unsaturated positions and from about 10 to about 22 carbon atoms reacted with an acrylic-type acid to produce a dicarboxylic acid may also be employed as the polycarboxylic acid. Other acrylic-type acids which may be used include angelic acid, tiglic acid, senecioic acid, crotonic acid, isocrotonic acid, vinylacetic acid, methacrylic acid and the like and mixtures thereof.

The polycarboxylic acid can also be an adduct of maleic acid or maleic anhydride with an olefin, where the olefin has from about 12 to 40 carbon atoms and one or two unsaturated positions.

At least one polyether glycol, a higher molecular weight poly(lower oxyalkylene) glycol is reacted with the above-described polycarboxylic acids to obtain the reaction products of the present invention. The molecular weight of the polyether glycol ranges from about 1,000 to about 20,000 and, more preferably, from about 3,000 to about 12,000. The recurring oxyalkylene groups contain up to about 4 carbon atoms and preferably have from 2 to 3 carbon atoms. Polyethylene glycol having a molecular weight from about 3,000 to about 12,000 is particularly useful for the preparation of the rheological additives of the present invention, however, polypropylene glycol and poly(ethylene-propylene) glycols within the above-described molecular weight ranges are also useful.

The various polyether glycols noted herein may have either a broad or a narrow molecular weight distribution so long as the molecular weight, on average, is within the aforementioned ranges. These ranges apply not only to polyether glycols falling within the range, but also to polyether glycol mixtures having an average molecular weight within the aforesaid range. The commercial glycols employed according to the present invention are within the aforementioned molecular weight ranges and the molecular weights thereof are average molecular weights. Some commercial polyethylene glycols that may be employed according to the present invention have average molecular weights of 1000, 3350, 8000, and 20000 and are sold under the trademark Carbowax 1000, 3350, 8000 and 20000.

Lower alkoxy poly(lower oxyalkylene) glycols, i.e., wherein one of the terminal hydroxyl groups is "capped" with an alkyl group having from 1 to about 4 carbon atoms may also be employed. These lower alkoxy poly(lower oxyalkylene) glycols also are within the molecular weight range as defined above for the polyether glycols. The terminal hydroxyl group generally is "capped" with a a methyl group, such as methoxypolyethylene glycol.

Mixtures of the above-described polyether glycols may also be used.

The second organic hydroxylic compound, which can be combined with the polyether glycol and reacted with the polycarboxylic acid or reacted separately therewith, is an aliphatic compound having a molecular weight less than 1000 and may contain one or two hydroxyl groups. Compounds having higher hydroxyl functionality can also be utilized, but preferably only as a portion of the total charge, where precautions are taken to minimize polymer formation via polycondensation. Useful hydroxylic compounds of the above types include aliphatic monohydric alcohols having from 3 to 22 and, more preferably, 6 to 18 carbon atoms; aliphatic dihydric alcohols having from 3 to 20 and, more preferably, 3 to 12 carbon atoms; ether diols, including polyether diols, having from 4 to 40 carbon atoms and from 1 to 20 ether moieties; and alkanolamines having 1 to 3 hydroxyl groups and 2 to 12 carbon atoms.

The various aliphatic monohydric alcohols that may be employed according to the present invention include isopropyl, n-propyl, n-butyl, 2-ethylhexyl, n-decyl, and cetyl alcohols or the like. Aliphatic dihydric alcohols may include butylene glycol, hexylene glycol, 2-ethyl-1,3-hexane diol and the like. Useful ether diols include diethylene glycol, dipropylene glycol, dibutylene glycol, polyether diols having average molecular weights less than 1,000 including triethylene glycol, tetraethylene glycol and appropriate higher homologs thereof.

Representative alkanolamines which can be employed include monoethanolamine, diethanolamine, triethanolamine, N-methyl ethanolamine, N-ethyl ethanolamine, N-methyl diethanolamine, N-ethyl diethanolamine, monoisopropanolamine, diisopropanolamine, triisopropanolamine, N-aminoethylethanolamine, and the like. Polyglycol amines, such as H-163 manufactured by Union Carbide Corporation, can also be employed.

In addition to the above-described hydroxylic compounds, acyclic ester diols having a molecular weight of from about 150 to about 400 may also be employed. Esterdiol 204 (trademark), a diol ester having a molecular weight of 204 may be employed in this respect. Esterdiol 204 is a commercial designation for the monoester of neopentyl glycol and 2,2-dimethyl-3-hydroxy propanoic acid. Hydroxy acids, such as ricinoleic acid and glycolic acid, may also be useful.

The rheological additives of the present invention are reaction products of the aforementioned polycarboxylic acids, a higher molecular weight polyether glycol and a second hydroxylic compound and are produced in accordance with conventional esterification procedures. For the esterification, all of the reactants may be added to the reaction as a unit charge and reacted or the polycarboxylic acid can first be partially reacted with the polyether glycol and then, in a subsequent step, the remaining unreacted carboxyl groups can be esterified with the second hydroxylic compound. In the latter type reaction, i.e., sequential reaction, the two steps may be carried out under different conditions. Polymerization is avoided or minimized by controlling the degree of reaction and the molar ratio of reactants. While an effort is made to react virtually all of the carboxyl functionality of the polycarboxylic acid, some unreacted hydroxylic compound and carboxylic acid can remain in the reaction product and is not removed.

The acid value (AV) is generally used to determine the extent of reaction. At least 55% and up to 100% of the available carboxyl functionality is reacted as measured by the acid value of the final product versus the acid value of the reactant mixture. Generally, more than 55% of the carboxyl groups are reacted except possibly in the case where the polycarboxylic acid is a tetracarboxylic acid. More usually, when di- and tricarboxylic acids are used, 75% or more of the carboxyl functionality is reacted with the polyether glycol and second hydroxylic compound. In a particularly useful embodiment of the invention, 90% or more of the carboxyl groups of the polycarboxylic acid are reacted. The ratio of polyether glycol to second hydroxylic compound can range from about 4:1 to 1:4 but is more generally from about 2:1 to 1:2, on a molar basis.

In another embodiment of the invention, all or a portion of any remaining carboxylic acid groups are converted to a salt form. These salts are also useful as rheological additives. Salts of ammonia and the Group IA or Group IIA Metals of the Periodic Table of the Elements, especially sodium or potassium, are particularly useful. The salts may be formed by reacting the ester containing free carboxyl groups with the hydroxides of the aforementioned metals or with ammonium hydroxide in an amount from about 50% to about 100% of the free carboxylic acid groups.

Salts may also be obtained from alkanolamines or heterocyclic nitrogen compounds having up to about 10 carbon atoms and 1 or 2 nitrogen atoms by reacting with the alkanolamine or heterocyclic nitrogen compound in a conventional manner. Various heterocyclic nitrogen compounds that may be employed comprise pyridine, piperidine, piperazine, morpholine, and alkyl-substituted imidazolines. Useful alkanolamines include ethanolamine, diethanolamine, triethanolamine and the like. In the case of alkanolamines, a portion of the alkanolamine may be reacted and serve as the second hydroxylic moiety, and a portion may be associated in salt form.

Especially advantageous rheological stabilizers of the invention are:

I. Esters of a dimer acid wherein approximately one-half of the carboxyl groups are esterified with a polyethylene glycol having a molecular weight from about 3,000 to about 12,000, and all or a portion of the remaining carboxyl groups are reacted with a hydroxylic compound selected from (a) n-decyl alcohol, (b) 2-ethyl-1,3-hexanediol, (c) dipropylene glycol, (d) polyethylene glycol having an average molecular weight from 200 to 600, (e) polypropylene glycol having an average molecular weight from 400 to 450, and (f) N-methyl diethanolamine;

II. Esters of trimer acid wherein approximately one-third to two-thirds of the carboxyl groups of the trimer acid are esterified with a polyethylene glycol having a molecular weight from about 3,000 to about 12,000 and all or a portion of the remaining carboxyl groups are reacted with an alcohol or diol (a)-(f) as defined above for I;

III. Esters of a polycarboxylic acid which is essentially a 1:1 adduct of dimer acid with maleic acid or maleic anhydride wherein approximately one-quarter to three-quarters of the carboxyl groups are esterified with a polyethylene glycol having a molecular weight of about 3,000 to about 12,000 and all or a portion of the remaining carboxyl groups are reacted with an alcohol or diol (a)-(f) as defined above for I; and IV. Ammonium, alkali metal and alkanolamine salts of I, II and III.

The coal-water slurries of the present invention are made from pulverized or powdered coal which has a particle size such that about 60% to about 90% will pass through a 200 mesh U.S. standard screen (a 75 micron sieve). Powdered or pulverized coal that may be converted into a water slurry is generally described by Funk in U.S. Pat. Nos. 4,282,006 and 4,416,666 both of which are incorporated herein by reference. The mixing of the powdered coal with water to form a slurry is also described by Funk in U.S. Pat. No. 4,477,260 at column 21, the entire disclosure of this reference being incorporated herein by reference. The rheological additives of the present invention are combined with water and the water in turn is mixed with the coal in a mixer such as a Hobart (trademark) mixer or the various art known equivalents thereof.

The coal slurry is made by adding about 0.1% to about 4% and, more preferably, 0.25 to 1.5% by weight, based on total slurry, of the rheological additive as defined herein to the water used in the coal-water slurry to form a coal-water slurry having anywhere from about 60 to about 80% solids by weight. By use of the rheological additives of the present invention the slurries are liquid at room temperature and easily pourable. Without the additives, the coal-water slurry is a non-pourable mass that, at room temperatures is solid. The slurries containing the rheological additives of the present invention should be maintained from about 0° C. up to about 95° C. preferably from about 2° C. to about 75° C. and most preferably less than 50° C.

The following Examples are illustrative.

EXAMPLE I

A mixed ester was prepared utilizing polyethylene glycol having an average molecular weight of 3350 (PEG 3350), dipropylene glycol and dimer acid. The dimer acid was a dimerized linoleic acid produced by Emery Chemicals (AV 189-197; SV 191-199; dibasic acid 77%). For the reaction, 176.7 g (0.6142 equivalents) dimer acid and 1028.8 g (0.6142 equivalents) PEG 3350 were charged to a two-liter four-neck round bottom flask equipped with nitrogen inlet tube, thermometer, and water trap. The reaction was run at 200° C. for 11 hours resulting in a drop in acid value of from 28.5 for the starting blend to 15.8.

240.9 g (0.0617 equivalents) of the resulting partial ester and 9.1 g (0.0678 moles) of dipropylene glycol were combined in a 500 ml four-neck round bottom flask equipped with subsurface nitrogen, thermometer and water trap. This reaction mixture was heated to 225° C. for 6.5 hours. When approximately half of the available carboxyl functionality was reacted (acid value 8.8), heating was terminated and the reaction was allowed to cool.

The mixed ester product thus obtained was evaluated as a rheological additive as follows: 1.75 g of the mixed ester product was dissolved in 62.2 grams of tap water with 0.18 g commercial defoamer and 4.38 g of a 1% aqueous solution of xanthan gum and 0.5% formaldehyde in the bowl of a Hobart mixer. The mixer bowl was then charged with 177.0 grams of freshly milled low-ash, low-sulfur Kanawha County W. Va. bituminous coal. This coal 98.8% dry matter was milled to 98.3% smaller than 50 mesh (300 microns), 73.7% smaller than 200 mesh (75 microns), 61.1% smaller than 325 mesh (45 microns). The coal had an ash content of 7.14% and sulfur content of 0.65% dry basis. The dispersant, additives and coal were allowed to mix at low speed (No. 1) for approximately 1 hour. Small water additions were made to account for evaporative losses.

The coal-water slurry was transferred to an 8-ounce bottle for viscosity determination using a Brookfield Viscometer LVF with a Helipath stand adaptor and an F spindle. Viscosity readings were made over a two inch volume of the slurry and averaged. The Brookfield viscometer was also used to measure a series of conventional viscositjes using a number 4 spindle without the Helipath stand. Solids content of the slurry was determined by evaporation of water from a weighed portion of the slurry and found to be 72.3% solids. pH was determined with a Cole Parmer pH Wand as 5.4. The viscosity at 6 rpm using the Helipath stand was initially 7000 cP and 1250 cP at 60 rpm by conventional determination. After 7 days no separation or settling was observed. The viscosity after 7 days was 14,800 cP at 6 rpm with the Helipath stand and 1400 cP at 60 rpm by conventional means.

EXAMPLE II

In a manner similar to that of Example I, PEG 3350 and dipropylene glycol were reacted with a commercial polybasic acid having an average carboxyl functionality of approximately three obtained from the addition of dimer acid and maleic anhydride. Approximately one-half of the carboxyl groups of the polycarboxylic acid was esterified with PEG 3350 and approximately one-half esterified with dipropylene glycol. For the reaction, 238.7g (1.0562 equivalents) of the polybasic acid and 1769.7g (1.0562 equivalents) PEG 3350 were charged to a 3 liter four-neck round bottom flask equipped with nitrogen inlet tube, thermometer and water trap and reacted at 210° C. for 5 hours until the acid value dropped from 29.6 to 15.8.

125g (0.0330 equivalents) of the above partial ester were transferred to a 500 ml four-neck round bottom flask and 4.9 g (0.0363 equivalents) of dipropylene glycol charged thereto. The reaction mixture was heated to 225° C. for 9.5 hours resulting in a further drop of acid value from 15.5 to 8.8.

To a Hobart mixer bowl were charged 1.75 grams of the above-prepared dispersant, 4.38 g of a 1% aqueous solution of xanthan gum with 0.5% formaldehyde, 0.18 g defoamer and 62.19 g tap water. The dispersant was allowed to dissolve and 177.0 g (98.8% dry matter) low-ash, low-sulfur Kanawha W. Va. bituminous coal added. The dispersant, additives and coal were allowed to mix at low speed (No. 1) for approximately 1 hour. Small adjustments were made to account for evaporative losses.

The slurry was transferred to an 8-ounce bottle and viscosity determinations were made as previously described above. The solids content of the slurry was determined to be 72.3% and pH was initially found to be 5.4. The viscosity at 6 rpm with the Helipath stand was initially 4700 cP and 1050 cP by conventional methods at 60 rpm. After 7 days' storage, no separation or settling was observed and the viscosity was found to be 8600 cP at 6 rpm with the Helipath stand and 1150 cP by conventional methods at 60 rpm.

EXAMPLES III–VIII

Following the procedure of Example I, the partial dimer-PEG 3350 ester prepared therein was reacted with a series of different hydroxylic compounds. For each reaction, 1.1 mole of the hydroxylic compound was charged and reacted as described for each 1.0 equivalent (1 molar on average) of carboxyl present in the partial ester as follows:

| Example No. | Hydroxylic Compound | Final AV |
|---|---|---|
| III | n-decanol | 7.35 |
| IV | n-decanol | 3.2 |
| V | polypropylene glycol (Avg. MW 425) | 8.32 |
| VI | polypropylene glycol (Avg. MW 425) | 3.3 |
| VII | N—methyl diethanolamine | 2.8 |
| VIII | 2-ethyl-1,3-hexanediol | 8.6 |

Slurries were prepared from 1% (based on coal weight) of each of the above dispersants with the Kanawha W. Va. coal and supplemental additives as previously described. Viscosity determination was made as previously described with the following results:

| | | Viscosity in cP | | | |
|---|---|---|---|---|---|
| | | Initial | | 14 Day Storage | |
| Dispersant of Example | % Solids | 6 rpm Helipath | 60 rpm Conventional | 6 rpm Helipath | 60 rpm Conventional |
| III | 72.5 | 9,400 | 1,000 | 11,700 | 1,450 |
| IV | 72.6 | 9,400 | 1,100 | 10,100 | 1,000 |
| V | 72.2 | 8,600 | 1,100 | 10,900 | 1,300 |
| VI | 72.5 | 10,900 | 1,350 | 10,100 | 1,400 |
| VII | 72.5 | 7,800 | 950 | 11,200 | 1,200 |
| VIII | 72.5 | 9,400 | 800 | 8,600 | 1,500 |

All of the above slurries were stable during storage.

EXAMPLE IX

A mixed ester of trimer acid (trimerized linoleic acid produced by Emery Chemicals; AV 175-192; SV 192-200; tribasic acid 80%) with polyethylene glycol and polypropylene glycol was prepared and evaluated as a dispersant for coal-water slurries. The mixed ester was prepared by first reacting 184.8 g (0.6094 equivalents) trimer acid with 1020.7 g (0.6094 equivalents) PEG 3350 as previously described at 200° C. for 8.5 hours until a drop in acid value of from 28.4 to a 15.1 was achieved.

181.3 grams (0.0460 equivalents) of the resulting partial ester product were then reacted with 19.6 g (0.0460 moles) of polypropylene glycol (avg. MW 425) at a temperature of 225° C. for 14.5 hours. The final product had an AV of 0.18 and was an effective rheological stabilizer for a coal slurry prepared from pulverized bituminous eastern Kentucky coal.

EXAMPLES X–XIV

A series of mixed esters were prepared using the general sequential reaction procedure previously described and the resulting products evaluated as rheological additives for the preparation of coal-water slurries. The various polycarboxylic acids and hydroxylic compounds used for the reactions as well as the approximate amount of total carboxyl functionality reacted with each hydroxylic compound were as follows:

| Example No. | Polycarboxylic Acid | Hydroxylic Compounds |
|---|---|---|
| X | Dodecenylsuccinic Anhydride | PEG 3350 (50%)<br>PPG 425 (50%) |
| XI | Dimer Acid | PEG 6000 (50%)<br>Dipropylene Glycol (50%) |
| XII | Acrylic Acid/Linoleic Acid Adduct (1:1) | PEG 3350 (50%)<br>Dipropylene Glycol (25%) |
| XIII | Dimer Acid/Maleic Anhydride Adduct (1:1) | PEG 8000 (67%)<br>N—methyl diethanolamine (33%) |

All of the above-described mixed ester products were effective rheological additives and produced stable mobile coal-water slurries with pulverized eastern Kentucky bituminous low-sulfur (<1%) coal. For example, a coal-water slurry (70% coal solids) containing 0.7 weight percent of the mixed ester product of Example XI and 29.3 percent water had an initial viscosity of 24,000 cP as measured at 6 rpm (Spindle F) using a Brookfield Viscometer LVF with a Helipath stand adaptor.

What is claimed is:

1. A coal-water slurry comprising coal, water and a rheological additive comprising the reaction product of a polycarboxylic organic acid having from about 16 to about 60 carbon atoms and from 2 up to 4 carboxyl groups, said polycarboxylic organic acid selected from the group consisting of dimer acids, trimer acids, adducts of unsaturated monocrboxylic acids or dimer acids with maleic anhydride in a molar ratio of about 1:1, adducts of linoleic acid or similar unsaturated monocarboxylic acids with acrylic-type acids in a molar ratio of about 1:1 and aducts of olefins having from about 12 to about 40 carbon atoms with maleic acid or maleic anhydride in a molar ratio of about 1:1; with (a) a polyether glycol having recurring oxyalkylene groups containing up to 4 carbon atoms and a molecular weight of from about 1,000 to about 20,000; and (b) an organic hydroxylic compound having a molecular weight of less than, 1,000 and containing one hydroxyl group; said molar ratio of (a) said polyether glycol to (b) said organic hydroxylic compound ranging from about 4:1 to about 1:4; said polycarboxylic acid having at least 55% up to essentially 100% of the available carboxylic groups reacted.

2. The coal-water slurry of claim 1 wherein the rheological additive is present in an amount from about 0.1 percent to about 4 percent.

3. The coal-water slurry of claim 2 which contains about 60 to about 80 percent solids by weight and 0.25 to 1.5 percent rheological additive.

4. The coal-water slurry of claim 3 wherein the coal has a particle size such that about 60 percent to about 90 percent passes through a 200 mesh U.S. standard sieve.

5. The coal-water slurry of claim 4 wherein the temperature of the slurry is maintained over a range from about 2° C. to about 75° C.

6. The coal-water slurry of claim 1 wherein (a) is selected from the group consisting of polyethylene glycol, polypropylene glycol and poly(ethylene-propylene) glycol and (b) is selected from the group consisiting of aliphatic monohydric alcohols having from 3 to 22 carbon atoms and alkanolamines having 1 hydroxyl group and 2 to 12 carbon atoms.

7. The coal-water slurry of claim 6 wherein the polycarboxylic acid has 75 percent or more of the carboxyl functionality reacted.

8. The coal-water slurry of claim 7 wherein the polyether glycol (a) is a polyethylene glycol having a molecular weight from about 3,000 to about 12,000.

9. The coal-water slurry of claim 8 wherein 90 percent or more of the carboxyl groups of the polycarboxylic acid are reacted.

10. The coal-water slurry of claim 9 wherein the molar ratio of (a) : (b) ranges from 2:1 to 1:2.

11. The coal-water slurry of claim 9 wherein the rheological additive is an ester of dimer acid having approximately one-half of the carboxyl groups esterified with a polyethylene glycol having a molecular weight from about 3,000 to about 12,000 and all or a portion of the remaining carboxyl groups reacted with n-decyl alcohol.

12. The coal-water slurry of claim 9 wherein the rheological additive is an ester of trimer acid wherein approximately one-third to two-thirds of the carboxyl groups are esterified with a polyethylene glycol having a molecular weight from about 3,000 to about 12,000 and all or a portion of the remaining carboxyl grops are react with n-decyl alcohol.

13. The coal-water slurry of claim 9 wherein the rheological additive is an ester of a carboxylic acid which is essentially a 1:1 adduct of dimer acid with maleic acid or maleic anhydride wherein approximately one-quarter to three-quarters of the carboxyl groups are esterified with a polyethylene glycol having a molecular weight of about 3,000 to about 12,000 and all or a portion of the remaining carboxyl groups are reacted with n-decyl alcohol.

14. The coal-water slurry of claim 1 wherein all or a portion of any unreacted carboxyl groups of the rheological additive are converted to a salt form.

15. The coal-water slurry of claim 14, wherein the salt is a salt of ammonia, a Group IA or IIA metal, an alkanolamine or a heterocyclic nitrogen compound containing up to about 10 carbon atoms and 1 or 2 nitrogen atoms.

16. The coal-water slurry of claim 15 wherein the salt is a salt of ammonia, sodium or potassium.

17. A coal-water slurry comprising coal, water and a rheological additive comprising the reactoin product of a polycarboxylic organic acid having from about 16 to about 60 carbon atoms and from 2 up to 4 carboxylic groups, said polycarboxylic acid selected from the group consisting of dimer acids, trimer acids, adducts of unsaturated monocarboxylic acids or dimer acids with maleic anhydride in a molar ratio of about 1:1, adducts of linoleic acid or similar unsaturated monocarboxylic acids with acrylic-type acids in a molar ratio of about 1:1 and adducts of olefins having from about 12 to about 40 carbon atoms with maleic acid or maleic anhydride in a molar ratio of about 1:1; with (a) a polyether glycol having recurring oxyalkylene groups containing up to 4 carbon atoms and a molecular weight of from about 1,000 to about 20,000; and (b) an organic hydroxylic compound having a molecular weight of less than 1,000 and containing 1 to 2 hydroxyl groups; said molar ratio of (a) said polyether glycol to (b) said organic hydroxylic compound ranging from about 4:1 to about 1:4; said carboxylic acid having at least 55% up to essentially 100% of the available carboxylic groups reacted, wherein said additive has a residual acid value of 2.8 or less.

18. The coal-water slurry of claim 17 wherein the rheological additive is present in an amount of from about 0.1% to about 4%.

19. The coal-water slurry of claim 18 which contains from about 60% to about 80% solids by weight and includes 0.25 to 1.5% rheological additive.

20. The coal-water slurry of claim 19 wherein the coal has a particle size such tht about 60% to about 90% by weight passes through a 200 mesh U.S. standard sieve.

21. The coal-water slurry of claim 20 wherein the slurry is maintained at a temperture in the range of from about 2° C. to about 75° C.

22. The coal-water slurry of claim 17 wherein (a) is selected from the group consisting of polyethylene glycol, polypropylene glycol and poly(ethylene-propylene) glycol and (b) is slected from the group consisting of aliphatic monohydric alcohols having from 3 to 22 carbon atoms, aliphatic dihydric alcohols having from 3 to 20 carbon atoms, ether diols having from 4 to 40 carbon atoms from 1 to 20 ether moieties, and alkanolamines having 1 to 3 hydroxyl groups and 2 to 12 carbon atoms.

23. The coal-water slurry of claim 22 wherein the polycarboxylic acid has 75 percent or more of the carboxyl functionality reacted.

24. The coal-water slurry of claim 23 wherein (a) said polyether glycol is a polyethylene glycol having a molecular weight from about 3,000 to about 12,000.

25. The coal-water slurry of claim 24 wherein 90 percent or more of the carboxyl groups of the polycarboxylic acid are reacted.

26. The coal-water slurry of claim 25 wherein the molar ratio of (a):(b) ranges from 2:1 to 1:2.

27. The coal-water slurry of claim 25 wherein the rheological additive is an ester of dimer acid having approximately one-half of the carboxyl groups esterified with a polyethylene glycol having a molecular weignt from about 3,000 to about 12,000 and all or a portion of the remaining carboxyl groups reacted with a hydroxylic compound selected from the group consisting of n-decyl alcohol, 2-ethyl-1,3-hexanediol, dipropylene glycol, polyethylene glycol having a molecular weight of from 200 to 600, polypropylene glycol having a molecular weight of from 400 to 450 and N-methyldiethanolamine.

28. The coal-water slurry of claim 25 wherein the rheological additive is an ester of a trimer acid wherein approximately one-third to two-thirds of the carboxyl groups are esterified with a polyethylene glycol having a molecular weight of from about 3,000 to about 12,000 and all or a portion of the remaining carboxyl groups are reacted with a hydroxylic compound selected from the group consisting of n-decyl alcohol, 2-ethyl-1,3-hexanediol, dipropylene glycol, polyethylene glycol having a molecular weight of from 200 to 600, polypropylene glycol having a molecular weight of from 400 to 450 and N-methyldiethanolamine.

29. The coal-water slurry of claim 25 wherein the rheological additive is an ester of a carboxylic acid which is essentially a 1:1 adduct of a dimer acid with maleic acid or maleic anhydride wherein approximately one-quarter to three-quarters of the carboxyl groups are esterified with a polyethylene glycol having a molecular weight of about 3,000 to about 12,000 and all or a portion of the remaining carboxyl groups are reacted witha hydroxylic compound selected from the group consisting of n-decyl alcohol, 2-ethyl-1,3-hexanediol, dipropylene glycol, polyethylene glycol having a molecular weight of from 200 to 600, polypropylene glycol having a molecular weight of from 400 to 450, and N-methyldiethanolamine.

30. The coal-water slurry of claim 17 wherein all or a portion of any unreacted carboxylic groups of the rheological additive are converted to a salt form.

31. The coal-water slurry of claim 30 wherein the salt is a salt of ammonia, a Group IA or IIA metal, an alkanolamine or a heterocyclic nitrogen compound containing up to about 10 carbon atoms and 1 or 2 nitrogen atoms.

32. The coal-water slurry of claim 31 wherein the salt is a salt of ammonia, sodium or potassium.

* * * * *